US005235306A

United States Patent [19]

Kalra et al.

[11] Patent Number: 5,235,306

[45] Date of Patent: Aug. 10, 1993

[54] FUSE ASSEMBLY

[75] Inventors: Varinder K. Kalra, Chesterfield, Mo.; Vernon R. Spaunhorst, Washington; Keith A. Spalding, Fenton, both of Mo.

[73] Assignee: Cooper Industries, Inc., Houston, Tex.

[21] Appl. No.: 915,158

[22] Filed: Jul. 15, 1992

[51] Int. Cl.[5] ..... H01H 85/04

[52] U.S. Cl. ..... 337/165; 337/163

[58] Field of Search ..... 337/163, 164, 165, 166

[56] References Cited

U.S. PATENT DOCUMENTS

| | | | |
|---|---|---|---|
| 2,300,620 | 11/1942 | Duerkob | 200/123 |
| 2,321,711 | 6/1943 | Taylor | 200/123 |
| 3,342,964 | 9/1967 | Kozacka | 337/164 |
| 4,533,895 | 8/1985 | Kowalik et al. | 337/165 |
| 4,992,770 | 2/1991 | Spalding et al. | 337/164 |
| 5,043,689 | 8/1991 | DiTroia | 337/165 |
| 5,075,664 | 12/1991 | Spalding et al. | 337/164 |

*Primary Examiner*—Harold Broome

*Attorney, Agent, or Firm*—Bruce Patterson; Jackie Duke; Eddie Scott

[57] ABSTRACT

The improved fuse assembly includes a trigger assembly having an electrically nonconductive barrel for receiving a spring loaded trigger therein and a heater strip disposed along the outer circumferential surface of the barrel with a pair of end flaps. One end flap has a hole therethrough which fits over the end of the trigger adjacent the short circuit element. A second flap fits over the end of the barrel adjacent the end ferrule. The short circuit element, which is electrically and mechanically linked to a ferrule on the opposite end of the tube from the trigger assembly, engages the trigger and heater element in a solder fusing alloy.

14 Claims, 5 Drawing Sheets

FUSE ASSEMBLY

BACKGROUND

This invention relates to the field of fuses, more particularly time delay dual element cartridge fuses capable of interrupting circuits under both overload and short circuit conditions.

Time delay fuses include a short circuit element connected to a spring trigger mechanism to form a fusing assembly, which is then held in an insulated tube and mechanically and electrically connected to opposed end ferrules. A time delay low voltage cartridge fuse of this type is disclosed in U.S. Pat. No. 4,992,770 (Spalding et al.).

The Spalding fuse has a short circuit element anchored to the spring trigger mechanism through a spring loaded bullet member. The bullet member is a cold headed part and extends outwardly from a barrel having a spring therein to bias the bullet away from the short circuit element under overload conditions. A paper cap surrounds the barrel with the closed end of the paper cap covering the end of the barrel opposite the bullet. The paper cap insulates the heater strip, which carries current from one end of the fuse, from contact with the barrel which is made of brass. This arrangement also ensures the current flows through the heater strip and does not bypass through the barrel to the ferrule. The paper cap also isolates the interior of the barrel from arc quenching fillers, such as sand, disposed within the fuse.

In order to ensure that the heater strip, bullet and short circuit element are mechanically and electrically linked, a fusing alloy is disposed at the juncture of the bullet, barrel and heater strip and at the juncture of the bullet and short circuit element. The fusing alloy is a low melting point solder designed to melt when the heat given off by the heater strip and short circuit element from a long term overload condition elevates its temperature to the melting point. Upon assembly of this sub-assembly into the insulating tube, the heater strip is folded over the sides of the insulated barrel and is soldered to a ferrule creating an electrical path therebetween.

In operation, the fuse will open under two types of conditions. If a short circuit is encountered, the heat produced in the short circuit element, which is caused by the passage of excess electric current through the necked portions thereof, causes the short circuit element to melt, opening the circuit across the opposed end ferrules of the fuse. Under long term overload conditions, the electric current flowing through the heater strip and short circuit element generates heat and after a sufficient period of time the heat will cause the fusing alloy to melt. This causes the spring to retract the bullet into the barrel, thus causing the bullet to pull away from the short circuit element, opening the circuit through the fuse.

SUMMARY

The improved fuse assembly includes a trigger assembly having an electrically nonconductive barrel for receiving a spring loaded trigger therein and a heater strip disposed along the outer circumferential surface of the barrel with a pair of end flaps. One end flap has a hole therethrough which fits over the end of the trigger adjacent the short circuit element. A second flap fits over the end of the barrel adjacent the end ferrule. The short circuit element, which is electrically and mechanically linked to a ferrule on the opposite end of the tube from the trigger assembly, engages the trigger in a solder coating or fusing alloy.

An object of the present invention is to provide a fuse assembly which reduces the number of components and thereby reduces the cost of manufacture. This is done by employing a one piece nonconductive barrel manufactured of plastic which eliminates the two piece paper cup insulated brass barrel of the prior art. The plastic barrel is cheaper to manufacture than the present screw machined brass barrel and lends itself to semi-automatic assembly.

Another object of the present invention is to provide a time lag fuse which has lower power losses and is more economical in service. The current invention utilizes a lower temperture fusing alloy which helps lower the fuse resistance and thereby reduce the power loss. This ensures more economical operation.

BRIEF DESCRIPTION OF THE DRAWINGS

These and other objects and advantages of the present invention are set forth below and further made clear by reference to the drawings, wherein:

FIG. 1 is a cross-sectional view of a fuse in the unopened condition having the improved trigger assembly of the present invention.

DESCRIPTION OF THE PREFERRED EMBODIMENT

Figure 5:
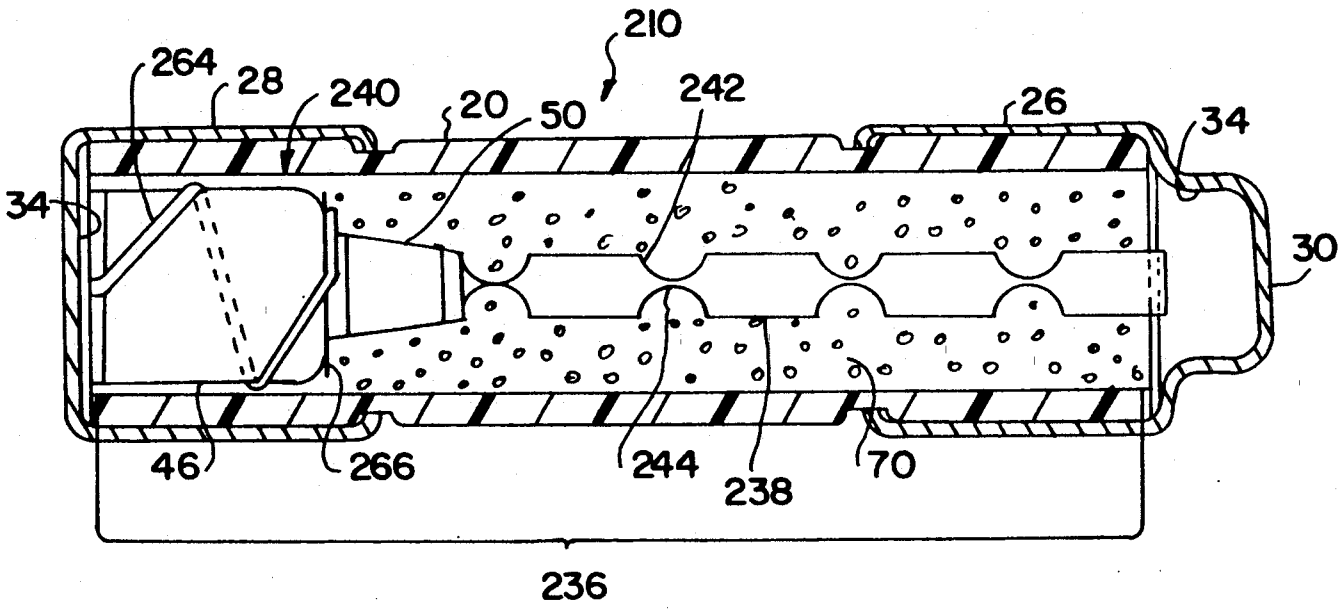
FIG. 5 is a cross-sectional view of a fuse showing a second alternate embodiment of the improved trigger assembly of the present invention with the heater element being a wire spirally wound on the plastic barrel to electrically connect the trigger and the ferrule.

With reference to FIG. 1, the improved fuse assembly of the present invention, denoted generally by numeral 10 includes an insulative tube 20 with opposed ends 22 and 24 having ferrules 26 and 28 thereon. Solder 34 is applied to the interior end surfaces 30 and 32 of ferrules 26 and 28 which are heated and crimped onto insulative tube 20 upon final assembly of the fuse 10. A fusing subassembly 36 is disposed within insulative tube 20 and electrically interconnects ferrules 26 and 28.

Fusing subassembly 36 includes a short circuit strip 38 and a spring loaded trigger assembly 40 disposed in series within tube 20. Short circuit strip 38 is manufactured from a silver material or copper and its alloys. A series of cutouts 42 are punched through the fusing material, leaving a series of narrow current strips 44 for carrying electric current therethrough. Short circuit strip 38 is typically sized to carry inrush currents of three to five times the fuse's rated current for short durations, but will melt almost instantaneously with the application of high current resulting from a short circuit.

Trigger assembly 40 is likewise mounted in tube 20 and includes an electrically nonconductive barrel 46 having radially inwardly turned flange 48 thereon. Barrel 46 is preferably manufactured from a plastic material. A metallic trigger 50 extends axially outwardly from barrel 46 and has a spring retainer lip 52 projecting radially outwardly at the end thereof received within barrel 46. A spring 54 is disposed against and between spring retainer lip 52 and flange 48. Trigger 50 extends outwardly from flange 48 and is connected to edge 56 of short circuit strip 38 with fusing alloy 58. Trigger 50 has a tapered outer surface 63 such that its diameter adjacent the spring retainer lip 52 is greater than its diameter adjacent the barrel flange 48. Thus, in FIG. 1 where trigger 50 is fully extended, the space between the side of the trigger 50 and the flange 48 is minimized.

Figure 2:
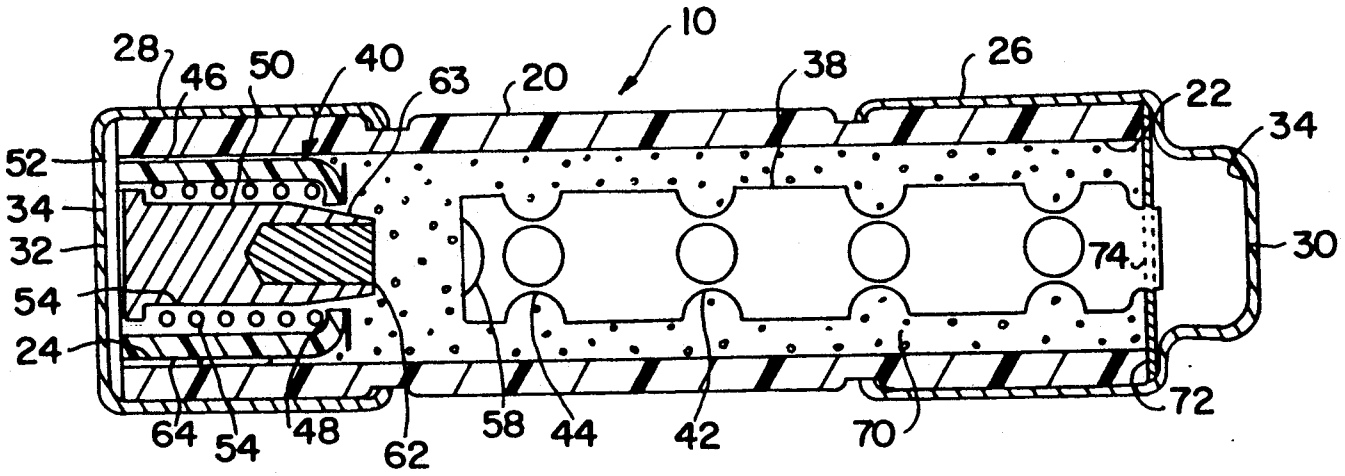
FIG. 2 is a cross-sectional view of the fuse of FIG. 1 following a long term circuit overload, allowing the spring trigger to open the fuse.
Figure 3:
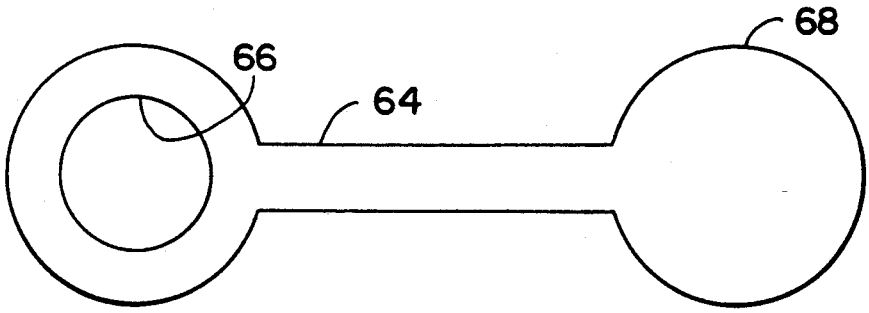
FIG. 3 is a plan view of the heater strip prior to assembly of the fuse of FIG. 1.

Referring to FIGS. 1-3, spring trigger assembly 40 further includes heater strip 64 which has one end bent over barrel 46 adjacent ferrule 28. Heater strip 64 is a strip of resistance metal, preferably a copper alloy, which generates heat when an electrical current is passed therethrough. The cross section of heater strip 64 is sized to generate little heat during normal conditions, i.e. the passage of rated fuse current, but will generate substantial heat when exposed to 135% to 500% of rated current. Heater strip 64 includes trigger retainer 66, which is a circular cutout through the center thereof. To obtain electrical engagement between short circuit strip 38 and heater strip 64, trigger retainer 66 with trigger 50 projecting therethrough is disposed in fusing alloy 60. The junction of trigger retainer 66 and trigger 50 in fusing alloy 60 retains the spring 54 in compression between flange 48 of barrel 46 and spring retainer lip 52 of trigger 50. As trigger 50 is composed of metal, an electrical circuit is created from heater strip 64, through fusing alloy 60 and trigger 50, and into edge 56 of short circuit element 38. Round flap 68 of heater strip 64 is folded over the end of barrel 46 adjacent ferrule 28 to seal the interior of barrel 46 from the remainder of the area inside the tube 20.

When fuse 10 opens, as shown in FIG. 2, fusing alloys 58 and 60 melt and the taper of the trigger 50 helps assure that barrel 46 and trigger 50 do not interfere, which would prevent opening of the fuse trigger. Fusing alloys 58 and 60 are a lead-tin-bismuth alloy having a low melting point which will melt when a long term overload condition occurs. However, other suitable low temperature alloy can be used.

To minimize the arcing after short circuit strip 38 melts in the insulative tube 20, arc quenching fillers are employed within tube 20 adjacent the fusing components. An arc quenching silicate 70 as loose sand fills the interior of tube 20 surrounding the trigger assembly 40. Washer 72 includes a slot 74 through which the opposite end of fusing strip 38 protrudes for solder attachment with ferrule 26.

As best seen in FIG. 2, fuse 10 is shown in the open position following a long term overload condition. Trigger assembly 40 has opened in response to the long term overload condition. The long term overload causes the heater strip 64 and short circuit element 38 to generate heat, which raises the fusing alloys 58 and 60 to their melting temperature thereby melting the interface between the short circuit strip 38 and trigger 50, between trigger 50 and trigger retainer 66 of heater strip 64, causing spring 54 to actuate trigger 50 within barrel 46 from short circuit strip 38 to open the circuit between ferrules 26 and 28.

Figure 4:
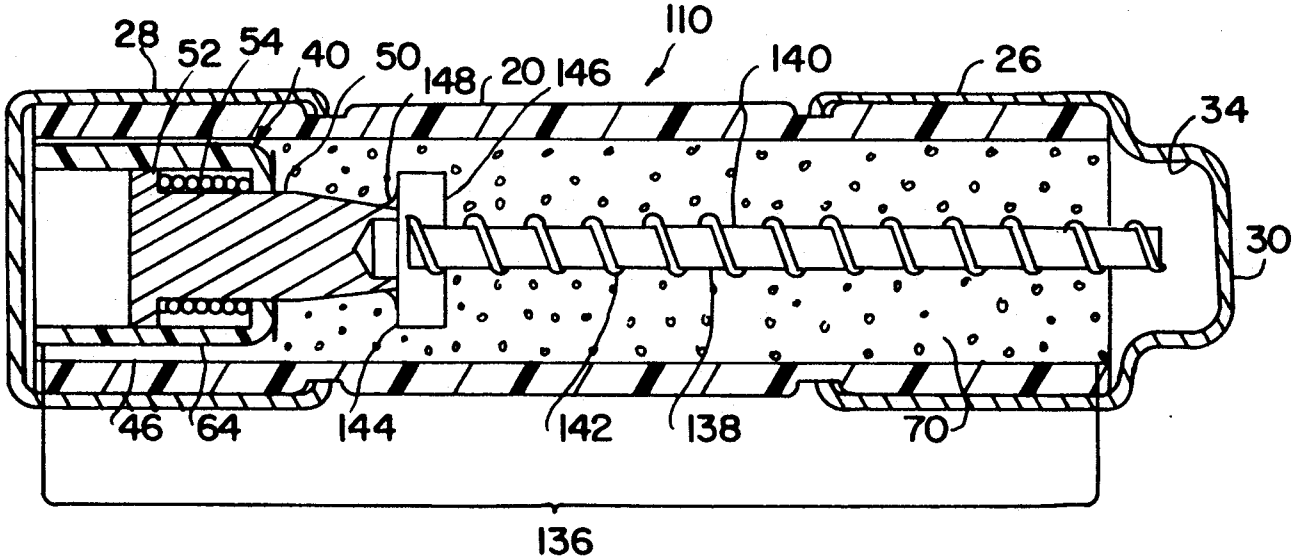
FIG. 4 is a cross-sectional view of a fuse showing a first alternate embodiment of the improved trigger assembly of the present invention with the short circuit element being a high temperature fiber core with a resistance wire spirally wound thereon.
Figure 5:
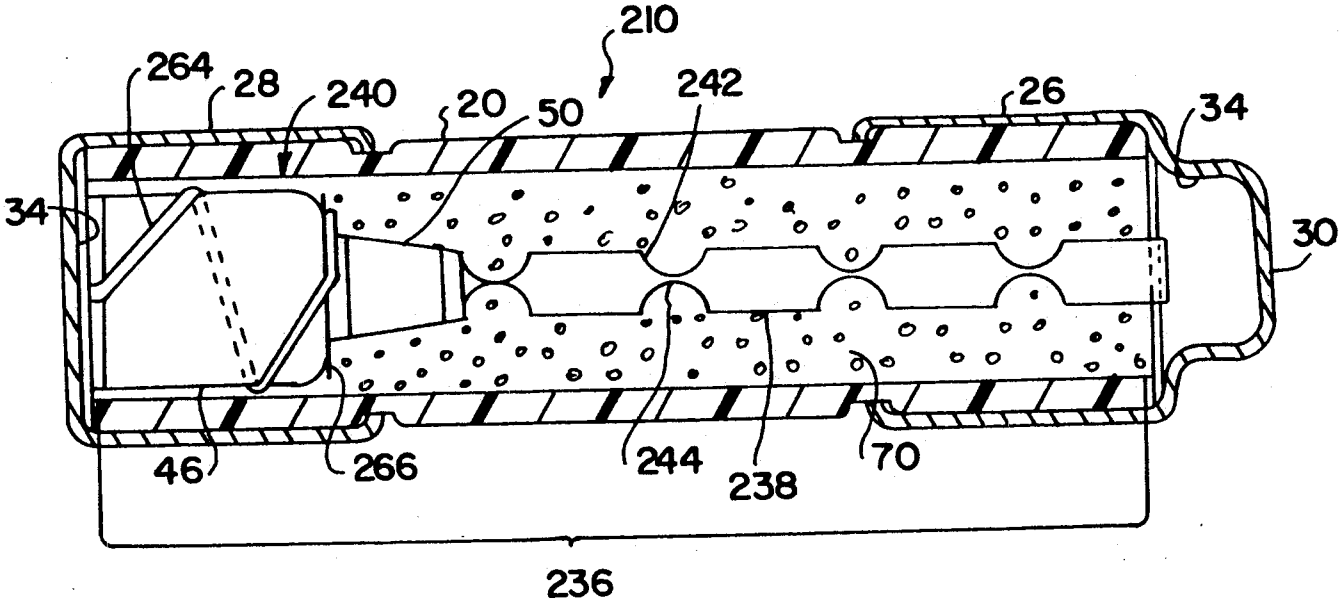

A first alternate embodiment of the improved fuse assembly is shown in FIG. 4. Those elements which are identical to those in the preferred embodiment retain the same numeral designation. This fuse assembly denoted generally by 110 has been shown to be particularly effective when the current range one-tenth (1/10) to one and four-tenths (1 4/10) amperes. Fuse assembly 110 is identical with the preferred embodiment with the exception of fusing subassembly 136 which includes a short circuit element 138 and a spring loaded trigger assembly 40 disposed in series within tube 20. Short circuit element 138 includes a core 140 of high temperature fiber with a fusing wire 142 spirally wrapped thereon. One end of short circuit element 138 is mechanically and electrically connected to ferrule 26 by solder 34. The opposite end of short circuit element 138 is electrically and mechanically connected to end cap 144 with solder 146. End cap 144 is electrically and mechanically connected to trigger assembly 40 by fusing alloy 148. In all other respects fuse assembly 110 functions as the preferred embodiment.

A second alternate embodiment of the improved fuse assembly is shown in FIG. 5. Those elements which are identical to those in the preferred embodiment retain the same numeral designation. This fuse assembly denoted generally by 210 has been shown to be particularly effective when the current range one and one-half (1 ½) to two and one-quarter (2 ¼) amperes. Fuse assembly 210 is identical with the preferred embodiment with the exception of fusing subassembly 236 which includes a short circuit strip 238 and a spring loaded trigger assembly 240 disposed in series within tube 20 and heater element 264. Short circuit strip 238 includes series of cutouts 242 leaving a series of narrow current strips 244 for carrying electric current therethrough. Short circuit strip 238 is sized to carry inrush currents of five times the rated current for short durations, but will melt almost instantaneously with the application of high current resulting from a short circuit. Heater element 264 is a fusible wire spirally wound on barrel 46 and welded to trigger retaining washer 266 and connected to ferrule 28 by solder 34. In all other respects fuse assembly 210 functions as the preferred embodiment.

The construction of our improved fuse assembly and the methods of its application will be readily understood from the foregoing description and it will be seen we have provided an improved fuse assembly which reduces the number of components and thereby reduces the cost of manufacture. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A fuse, comprising:

an insulating tube having opposed first and second ends;

electrically conductive ferrules disposed on said first and second ends;

a short circuit strip in electrically conductive engagement with said electrically conductive ferrule on said first end and extending inwardly through said tube;

a trigger assembly disposed adjacent to said second end including:

a spring loaded trigger disposed within and projecting outwardly from a first end of an open ended barrel, said barrel made of an electrically nonconductive material;

a substantially planar heater strip in conductive engagement with said ferrule and covering a second open end of said open ended barrel and extending therefrom, and;

said trigger, short circuit strip and said substantially planar heater strip mechanically and electrically interconnected in a fusing alloy.

2. A fuse according to claim 1 wherein said trigger assembly further includes:

a spring retainer flange disposed radially about one end of said trigger within said barrel, said barrel includes a lip projecting inwardly at its open end opposite said ferrule, and a spring disposed between said flange and said lip.

3. A fuse according to claim 2 wherein said barrel is manufactured from plastic.

4. A fuse according to claim 1 wherein said short circuit strip is disposed in an arc quenching material.

5. A fuse according to claim 4 wherein said arch quenching material is sand.

6. A fuse according to claim 1 wherein said trigger assembly is disposed in arc quenching silicates.

7. A fuse according to claim 6 wherein said arch quenching silicates are sand.

8. A fuse according to claim 1 wherein said trigger is manufactured from an electrically conductive material.

9. A fuse according to claim 8 wherein said trigger is manufactured from copper or one of its alloys.

10. A fuse according to claim 1 wherein said trigger is prelugged with fusing alloy.

11. A fuse according to claim 1 wherein said planar heater strip includes a first flap and a second flap interconnected by a conductive portion, said first flap including a hole through which said trigger extends and said second flap of said planar heater strip and said second ferrule mechanically and electrically interconnected in a solder fusing alloy.

12. A fuse according to claim 1 wherein said heater strip is spirally wound about said barrel.

13. A fuse according to claim 12 wherein said barrel is constructed and arranged to accept said spirally wound heater strip.

14. A fuse according to claim 13 wherein said heater strip is a wire.

* * * * *